United States Patent [19]

Seiler

[11] Patent Number: 4,753,146

[45] Date of Patent: Jun. 28, 1988

[54] PORTABLE ELECTRONIC DRUM SET

[76] Inventor: Brock Seiler, Five E. 22nd St., Apt. 21M, New York, N.Y. 10010

[21] Appl. No.: 935,012

[22] Filed: Nov. 26, 1986

Related U.S. Application Data

[63] Continuation-in-part of Ser. No. 678,166, Dec. 4, 1984, abandoned.

[51] Int. Cl.[4] ..... G10H 1/00

[52] U.S. Cl. ..... 84/1.01; 84/1.24; 84/DIG. 7; 84/DIG. 12

[58] Field of Search ..... 84/1.01, 1.16, 1.24, 84/411 M, 411 R, 421, 402, 422 R, DIG. 7, DIG. 12

[56] References Cited

U.S. PATENT DOCUMENTS 4,043,241 8/1977 Liu ..... 84/1.01
4,226,154 10/1980 Easler ..... 84/DIG. 12
4,635,516 1/1987 Giannini ..... 84/DIG. 7

FOREIGN PATENT DOCUMENTS 2112991 7/1983 United Kingdom ..... 84/1.24

*Primary Examiner*—Russell L. Adams

*Attorney, Agent, or Firm*—Thomas R. Morrison

[57] ABSTRACT

A portable set of electronic drums includes individual drum units which are attached to different parts of a musician's body to provide maximum mobility for a stage performance. An impulse analyzer with each of the drum units processes the outputs of the drum units for transmission to a synthesizer which further processes and amplifies the resulting sound for application to a loudspeaker. A wire, radio transmitter or optical link may be employed to communicate the signals from the musician's body to a stationary synthesizer and loudspeaker. A percussion transducer in the musician's shoe may be employed to further increase the flexibility of the system. The output of the percussion transducer in the musician's shoe is combined with the outputs of the remaining drum units to create a total drum signal. In addition, the outputs of the shoe percussion transducer and the drum units may be employed to control the energization of optical emitters on the person of the musician. An electronic filter is employed to prevent stray sound or impulses from triggering the system. Elongated support bars for the transducers at a short distance from the shoes insulate stray sounds from the transducers.

5 Claims, 3 Drawing Sheets

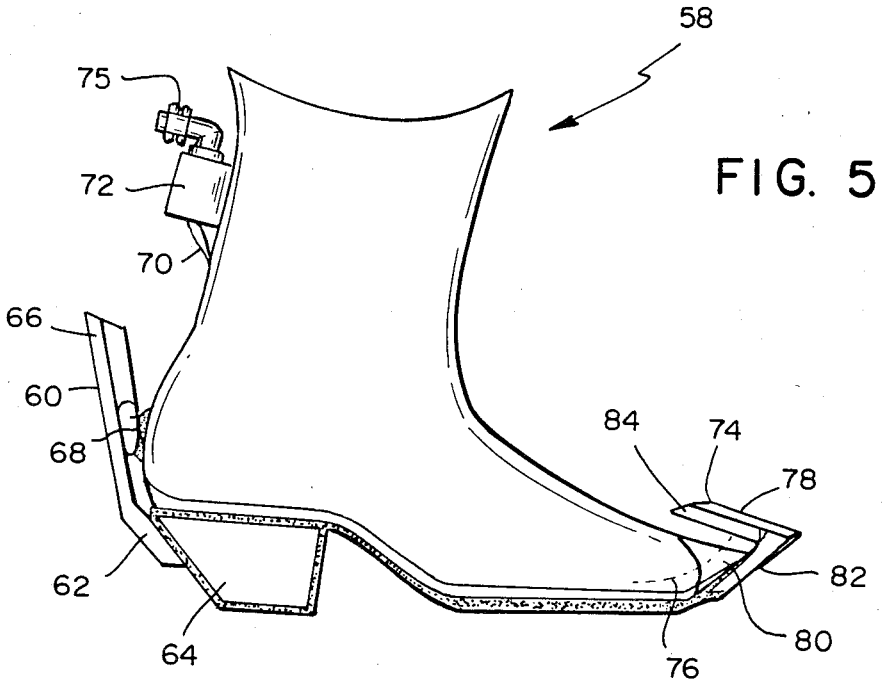
FIG. 5
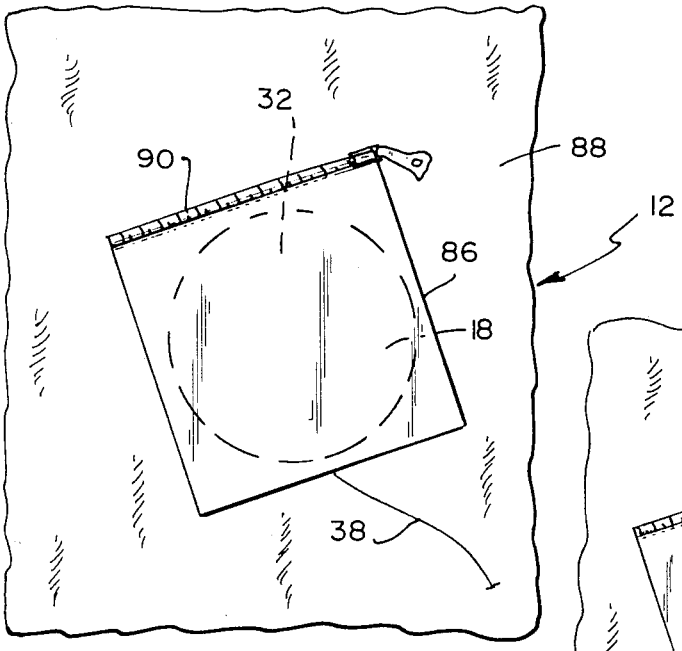
FIG. 6
FIG. 7
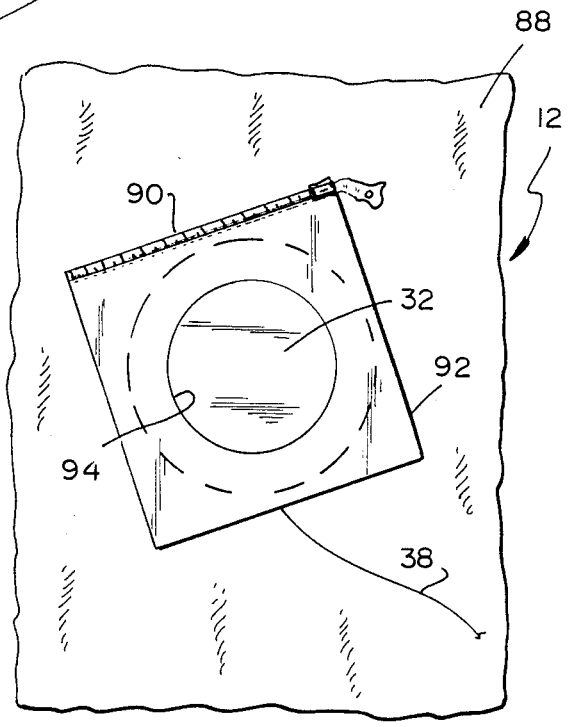

PORTABLE ELECTRONIC DRUM SET

This is a continuation-in-part of application Ser. No. 678,166 filed Dec. 4, 1984, entitled Portable Electronic Drum Set, abandoned upon the filing of this application.

BACKGROUND OF THE INVENTION

The present invention relates to musical instruments and, more particularly, to a portable electronic drum set which may be carried and worn by a performer while it is played.

Two trends in the concert performance of modern music include substituting electric or electronic instruments for traditional acoustic instruments, such as, for example, electric guitars, electronic keyboards, and electronic drums and increasing the mobility of musicians while performing with their instruments. Guitarists, for example, find such movement relatively simple since the guitar is easily portable.

Conventional drums are bulky. Although portable drums are used in, for example, marching bands, drums in marching bands are principally for cadence and lack the range of expression desired in a stage performance. Thus, a fully mobile drum set for a stage performance has not been achieved, even though drums are among the most common of all musical instruments, and are found in most modern bands.

Electronic drums are known, and are described, for example, in U.S. Pat. No. 2,655,071. Other currently available electronic drums are sold under various trademarks, including, for example, SDS7, by Simmons Electronics Ltd. A full set of drums contains many different drums and accompanying percussion instruments, including, for example, snare drums, kettle drums, cymbals, and a bass drum. Although many electronic drums are portable in the sense that they may be carried from place to place, they usually need a supporting surface which prevents the player thereof from moving about a stage while performing.

A musical shoe is disclosed in U.S. Pat. No. 4,034,241, which produces musical tones when keys on the underside thereof are depressed. This patent provides no suggestion of a percussion instrument or the integration of the musical shoe into a portable electronic drum set.

OBJECTS AND SUMMARY OF THE INVENTION

Accordingly, it is an object of the invention to provide a set of electronic drums which overcomes these and other drawbacks of the prior art.

It is a further object of the invention to provide a set of electronic drums which is portable, and may be carried by a musician while being played.

It is a still further object of the invention to provide a portable electronic drum set in which a plurality of percussion elements are adapted for distribution about the body of a performer to enable a spontaneous and natural usage thereof.

It is a still further object of the invention to provide a portable electronic drum set having percussion surfaces adapted for distribution about the body of a performer and having at least one percussion transducer adapted for installation in the shoe of the performer.

It is a still further object of the invention to provide a drum set having percussion transducers worn on a performer's body, stationary processing electronics and a transmission device for transmitting from the performer's body to the stationary processing electronics. The transmission device may employ flexible cable, radio or light transmission.

It is a still further object of the invention to provide an electronic drum set including at least one drum transducer affixed external to a shoe worn by the performer.

Briefly stated, the present invention provides a portable set of electronic drums having individual drum units which are attached to different parts of a musician's body to provide maximum mobility for a stage performance. An impulse analyzer associated with each of the drum units processes the outputs of the drum units for transmission to a synthesizer which further processes and amplifies the resulting sound for application to a loudspeaker. A wire, radio transmitter or optical link may be employed to communicate the signals from the musician's body to a stationary synthesizer and loudspeaker. One or more percussion transducers in, or affixed to, the musician's shoe may be employed to further increase the flexibility of the system. The output of the percussion transducer in, or on, the musician's shoe is combined with the outputs of the remaining drum units to create a total drum signal. In addition, the outputs of the shoe percussion transducer and the drum units may be employed to control the energization of optical emitters on the person of the musician.

According to an embodiment of the invention, there is provided a portable musical instrument for use by a musician, comprising: at least one means for generating an impulse in response to percussion thereon, means for analyzing the impulse, and for generating at least one drum sound in response thereto, means for attaching the at least one means to at least one part of a body of the musician, a shoe, means for affixing a transducer to the shoe, the transducer being effective for producing at least a second drum sound when actuated, and means for permitting actuation of the transducer.

According to a feature of the invention, there is provided a portable set of electronic drums for use by a musician, comprising: at least first and second means for generating a first signal in response to a percussion thereon, means for generating an output signal in response to the first signal, means for attaching each of the at least first and second means to different areas on a body of the musician, means for generating an acoustic signal in response to the output signal, and the means for attaching including at least one pocket in a garment worn by the musician, the pocket containing at least the first means for generating a first signal.

According to a further feature of the invention, there is provided a portable musical instrument for use by a musician comprising: a shoe having a bottom, at least one transducer, means for affixing the at least one transducer to the shoe, the at least one transducer being effective for generating a drum signal in response to vibration thereof, and the means for affixing including means for supporting the at least one transducer remote from the shoe.

According to a still further feature of the invention, there is provided a portable musical instrument for use by a musician, comprising: at least first means for generating a first impulse in response to percussion thereon, means for analyzing the first impulse, and for generating a first signal in response thereto, first means for attaching the at least first means to at least a first part of a body of the musician, a shoe having a bottom, means for generating a second impulse in response to vibration transmitted from the shoe, means for analyzing the second impulse, and for generating a second signal in response thereto, and second means for attaching the shoe to the musician.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 5 is side view of a portion of a portable drum set wherein at least one of the drum transducers is mounted external to a shoe.

FIG. 6 is a front view of a portion of an item of apparel wearable by a musician and including a pocket for supporting a portion of the drum set.

FIG. 7 is a front view corresponding to FIG. 6 wherein a hole in the pocket permits direct percussive contact with a surface of the portion of the drum set contained therein.

DETAILED DESCRIPTION OF THE PREFERRED EMBODIMENT

Figure 1:
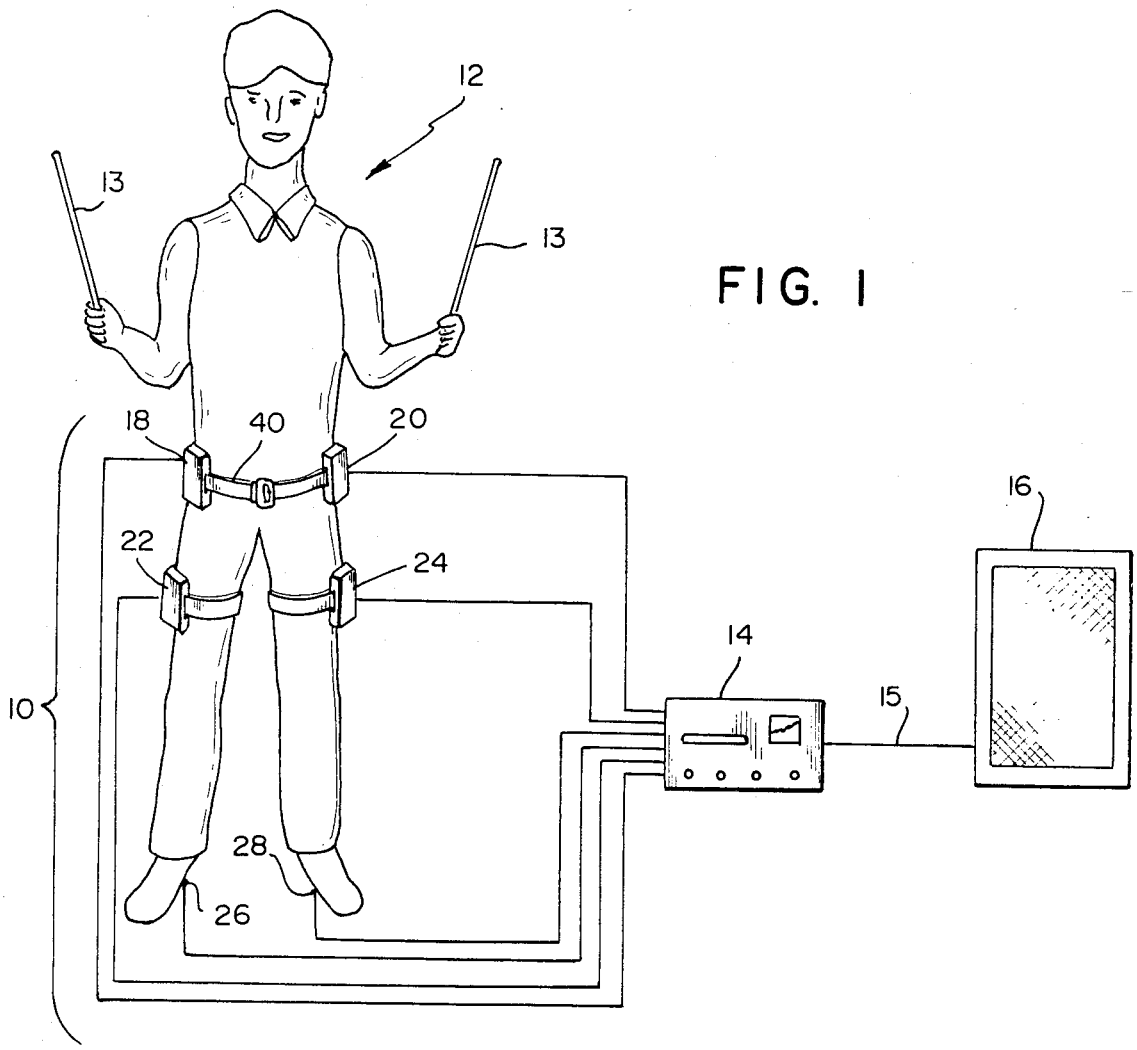
FIG. 1 is a front view of a musician wearing a portable set of electronic drums in accordance with a preferred embodiment of the invention, and a partial schematic diagram of additional equipment used with the portable set of electronic drums.

Referring to FIG. 1, a set of electronic drums 10 in accordance with the invention is shown carried on the body of a musician 12 holding two drumsticks 13. A music synthesizer 14, receiving signals from set of electronic drums 10, generates an acoustic output signal 15 for application to a loudspeaker 16.

Set of electronic drums 10 comprises a plurality of different percussion instruments such as, a high hat 18, a floor tom 20, a snare 22, a tom tom 24, a first bass drum 26 and a second bass drum 28. It will be appreciated, however, that more or less than the illustrated number and types of musical instruments may be worn by musician 12 without departing from the spirit and scope of the invention. Each percussion instrument includes an acoustic transducer whose output is processed by synthesizer 14 in a conventional manner to produce a sound appropriate to the instrument being struck.

Figure 2:
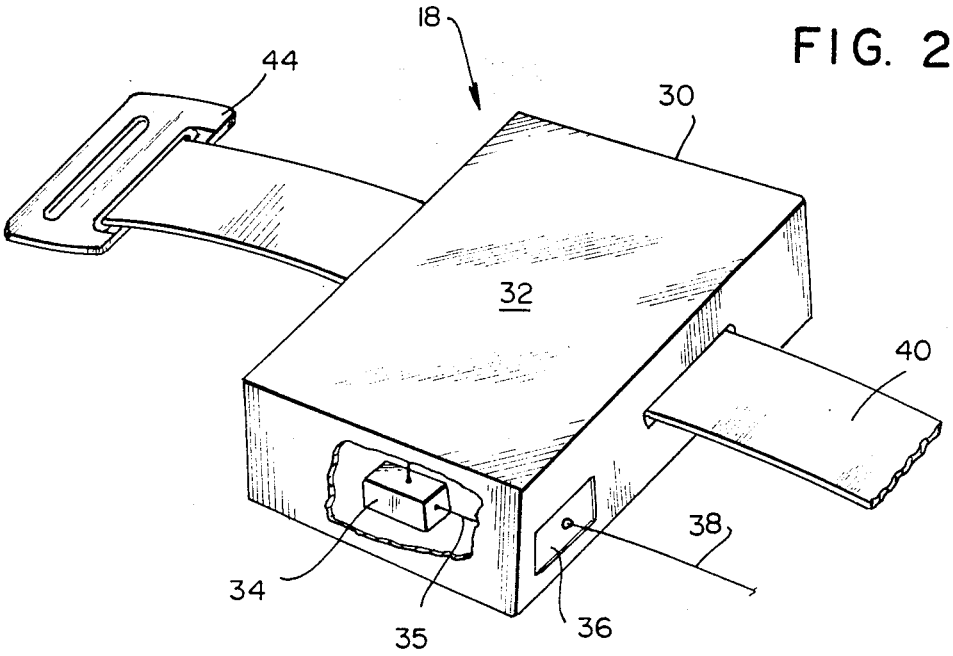
FIG. 2 is a perspective view, partially cut away, of a single electronic drum from the portable set of electronic drums of FIG. 1.

Referring now to FIG. 2, high hat 18 is selected as an illustrative example of a single musical instrument of set of electronic drums 10. High hat 18 includes an electronic drum 30, having a percussion surface 32 capable of producing an electrical signal upon being struck. An impulse analyzer 34 conventionally called a MIDI unit, may be disposed in electronic drum 30 as shown, elsewhere on the body of the musician where its functions may be shared by other transducers, or alternatively may be contained in synthesizer 14. An output signal 35 is applied to a transmitter 36 for transmission to music synthesizer 14 (FIG. 1) using, for example, a wire 38.

Electronic drum 30 includes a strap 40 with a buckle 44 for strapping about a convenient part of the body of musician 12. Other attachment means such as, for example, snap fasteners or complementary strips of self-adhering Velcro tape may be employed. Alternatively, or in addition, electronic drum 30 may be installed in a pocket provided for that purpose in the costume of musician 12. Such a pocket may cover all, or part of percussion surface 32. In one embodiment of the invention, an opening in a pocket containing high hat 18 permits direct contact with percussion surface 32 whereby the desired sharp impulse-type contact with percussion surface is attained. One or more of the other drums in set of electronic drums 10 may be similarly affixed to the body of musician 12.

Figure 3:
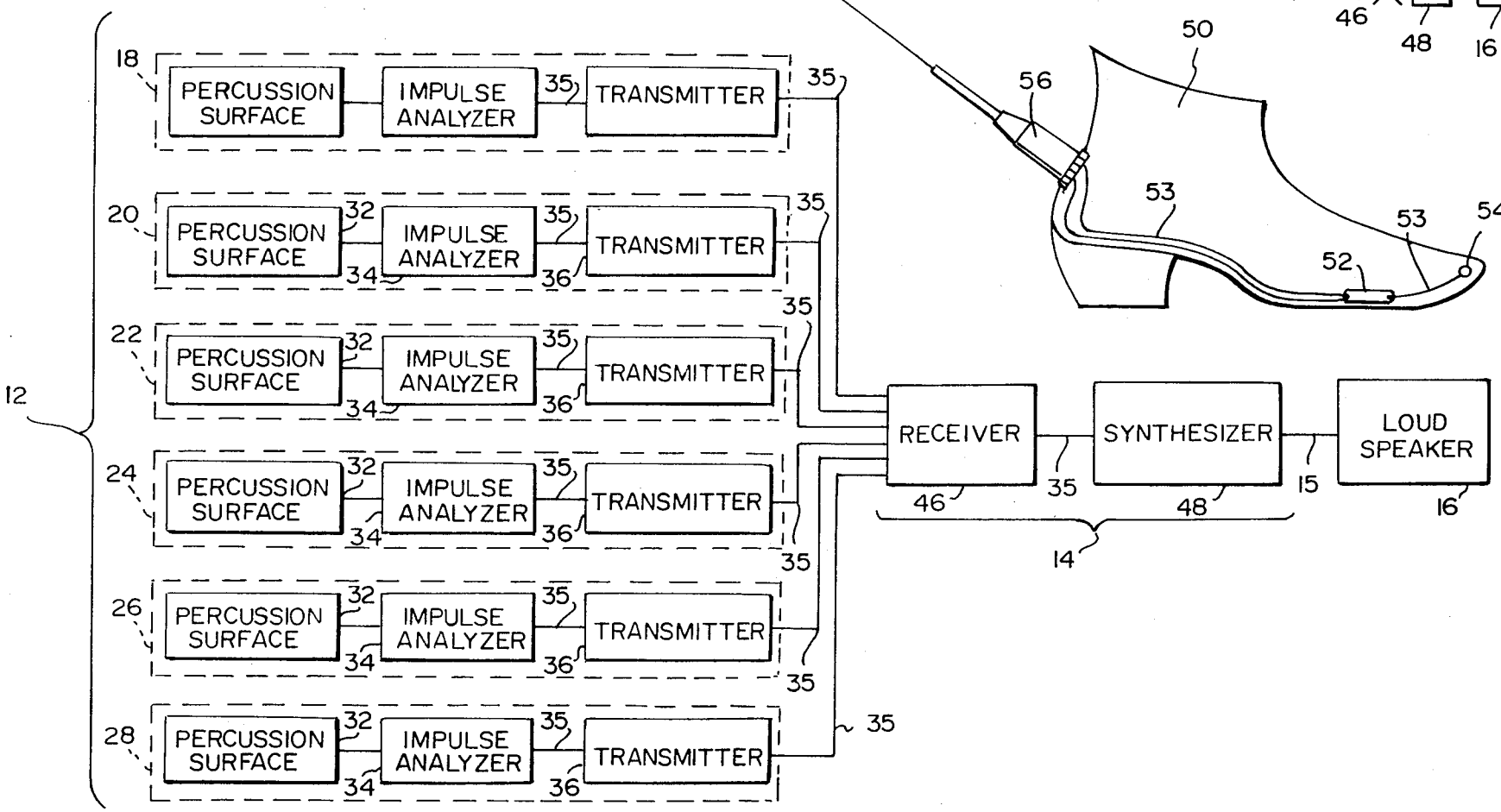
FIG. 3 is a block diagram of the portable set of electronic drums and the additional equipment of FIG. 1.

Referring now to FIG. 3, when one or more selected percussion surfaces 32 are struck, corresponding output signals 35 from related impulse analyzers 34 are transmitted by corresponding transmitters 36 to a receiver 46 which may be conveniently located within music synthesizer 14. Receiver 46, in turn, sends output signal 35 to a synthesizer 48, which generates output signal 15 indicative of the sound associated with the original impulse, and relays output signal 15 to loudspeaker 16.

Figure 4:
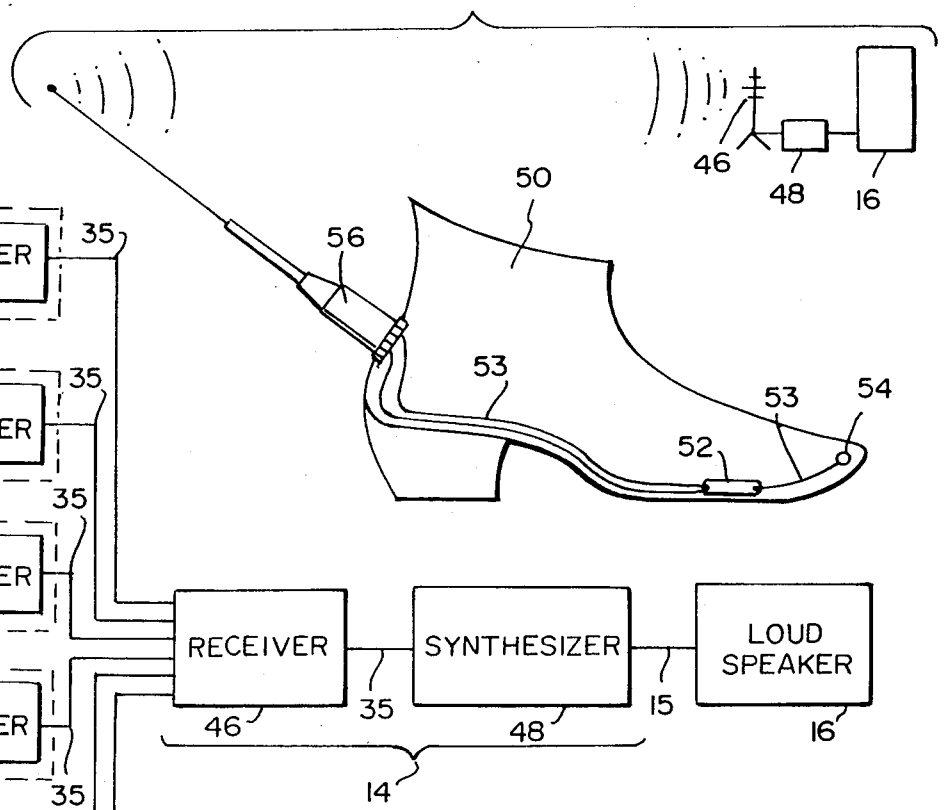
FIG. 4 is a diagram of a further embodiment of one of the portable set of electronic drums wherein at least one transducer is mounted in a shoe.

Referring now to FIG. 4, a shoe 50 includes a pressure transducer 52, a light 54 and a radio transmitter 56. Pressure transducer 52 is sensitive to pressure, and may be, for example, a piezoelectric transducer. A piezoelectric transducer responds to changes in pressure applied to its surfaces by generating a voltage in proportion thereto. An output signal 53 from pressure transducer 52 may be processed in a manner similar to the signals from the remainder of set of electronic drums 10 to provide an additional drum sound such as, for example, a bass drum sound. Each time shoe 50 taps a surface, pressure transducer 52 produces a drum sound according to the processing its output signal 53 receives. The signal from pressure transducer 52 may be amplified by conventional means, not shown, to energize light 54 in time with the contact of shoe 50 with the surface. This enables the generation of interesting acousto-optical effects in which simultaneous energization of light 54 and loudspeaker 16 may be achieved by musician 12. Light 54 may be an incandescent or other type of light, but in the preferred embodiment, one or more light-emitting diodes are preferred because of the low power requirements of such devices. In addition to, or in substitution for, the signal from pressure transducer 52, signals from set of electronic drums 10 may be employed for controlling the energization of light 54.

Radio transmitter 56 may be employed to transmit output signal 53 of pressure transducer 52 to receiver 46 for inclusion of the musical output of shoe 50 with the remainder of the signals produced by electronic drum set 10. In addition, the outputs of all of the remainder of set of electronic drums 10 may be communicated over radio transmitter 56 to receiver 46 rather than using wire 38. When used in this way, radio transmitter adds to the mobility of musician 12 freeing him, as it does, from the constraints of wire 38.

If musician 12, besides playing set of electronic drums 10, also leads a musical group, the inclusion of shoe 50 into set of electronic drums 10 offers the opportunity for musician 12 to set the tempo for the musical group by tapping shoe 50 on the stage. This permits a smoother and less obtrusive way for the musical group to begin a musical number.

I have discovered that mounting pressure transducer 52 within shoe 50, as shown in FIG. 4, permits extraneous sounds to enter transducer 52. Such extraneous sounds originating, for example, in scuffing contact with the floor or squeaking of the leather or plastic of which shoe 50 is made, may be transmitted for reproduction by synthesizer 48 and loudspeaker 16.

One technique for removing such extraneous sounds includes conventional electronic filtering. Such electronic filtering may include band-stop filtering for removing particular frequency ranges of the signal produced by 52. Such frequency ranges may include those predominant in shoe squeaks and floor scuffing. In addition, high-pass electronic filtering may be provided for removing low-frequency components characteristic of rubbing or scuffing sounds while passing higher frequencies relatively unaltered. Corresponding high-pass filtering may be employed with, or in the alternative to, the foregoing types of filtering. The type of signal desired from pressure transducer 52 is characteristically an impulse type of signal. Advantage may be taken of the fact that impulse-type signals are relatively rich in higher harmonics in contrast to the extraneous signals from which the desired signal is to be discriminated. Thus, high-pass filtering of the signal from pressure transducer 52 may be performed with a cut-off frequency set higher than the fundamental frequency of the desired signal.

Referring now to FIG. 5, there is shown, generally at 58, a shoe including means for producing drum signals while suppressing undesired interfering signals. A transducer support bar 60 is rigidly affixed at a lower end 62 to the rear end of shoe 58, such as at a heel 64 thereof. A cantilevered portion 66 of transducer support bar 60 supports a transducer 68 away from direct contact with the remainder of shoe 58. Signals generated by transducer 68 are carried by wires 70 to a connector support 72 affixed at any convenient point on shoe 58. Connector support 72 supports a conventional connector 75 such as, for example, a conventional BNC connector, for convenient wire connection between transducer 68 and synthesizer 48 (not shown in FIG. 5).

A second transducer support bar 74 is disposed at a toe 76 of shoe 58 for supporting a second transducer 78 remote from shoe 58. An interface block 80 may be provided, as appropriate for connection of a lower portion 82 of transducer support bar 74. An upper portion 84 of transducer support bar 74, supporting transducer 78, is bent backward over toe 76 both to prevent interference with external objects, and for desirable acoustic properties thereby attained.

I have discovered that the acoustic response of transducers 68 and 78 can be modified by selection of materials, dimensions and shapes of their respective transducer support bars 60 and 74. In particular, I have discovered that making transducer support bars 60 and 74 of a polycarbonate plastic tends to provide mechanical filtering of undesired sounds whereby impact of a bottom surface of shoe 58 against a floor is effective for producing the desired drum-sound signal output without permitting interference from scuffing and squeaking sounds. The distance from shoe 58 that transducers 68 and 78 are mounted from shoe 58, and the intervening angles over which transducer support bars 60 and 74 are bent, also have an effect. Different types of shoe 58, transducers 68 and 78, and different types of floor surfaces may require harder or softer material, or different shapes in transducer support bars 60 and 74 to attain the desired attenuation of interfering sounds or vibrations.

Referring now to FIG. 6, an alternative way of affixing one of the elements of set of electronic drums 10 to musician 12 is shown. A pocket 86, integrally formed in an item of apparel 88 such as, for example, a jumper, contains a high hat 18 which, for purposes of illustration, is assumed to be round. A slide fastener 90 secures high hat 18 in pocket 86. In this embodiment, percussive contact between a drumstick (not shown) and percussion surface 32 of high hat 18 takes place through the fabric of high hat 18.

Referring now to FIG. 7, a pocket 92 includes a hole 94 formed generally centrally therein for permitting direct percussive contact between a drumstick and percussion surface 32, thereby eliminating the need for attaining the percussive contact through an intervening layer of fabric.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A portable set of electronic drums for use by a musician, comprising:

at least first and second means for generating a first signal in response to a percussion thereon;

means for generating an output signal in response to said first signal;

means for attaching each of said at least first and second means to different areas on a body of said musician;

means for generating an acoustic signal in response to said output signal; and said means for attaching including at least one pocket in a garment worn by said musician, said pocket containing at least said first means for generating a first signal.

2. A portable set of electronic drums in accordance with claim 1 wherein said pocket includes a hole, said hole permitting direct percussion on said first means without an intervening fabric layer.

3. A portable musical instrument for use by a musician comprising:

a shoe having a bottom;

at least one transducer;

means for affixing said at least one transducer to said shoe;

said at least one transducer being effective for generating a drum signal in response to vibration thereof; and said means for affixing including means for supporting said at least one transducer remote from said shoe.

4. A portable musical instrument in accordance with claim 3 further comprising a light and means responsive to said vibrations for energizing said light.

5. A portable set of electronic drums according to claim 3 in which the transducer affixing means is an elongated support bar secured at one end to the shoe.

* * * * *